US008181427B2

(12) United States Patent
Kobierzycki et al.

(10) Patent No.: US 8,181,427 B2
(45) Date of Patent: May 22, 2012

(54) PACKING AND PACKAGING SYSTEM

(75) Inventors: Bernard Kobierzycki, Octeville sur Mer (FR); Yannick Petijean, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 327 days.

(21) Appl. No.: 12/444,965

(22) PCT Filed: Oct. 10, 2007

(86) PCT No.: PCT/FR2007/001648

§ 371 (c)(1),
(2), (4) Date: Jul. 16, 2009

(87) PCT Pub. No.: WO2008/043912

PCT Pub. Date: Apr. 17, 2008

(65) Prior Publication Data

US 2010/0043357 A1 Feb. 25, 2010

(30) Foreign Application Priority Data

Oct. 11, 2006 (FR) ..... 06 08897

(51) Int. Cl.
*B65B 51/10* (2006.01)

(52) U.S. Cl. ..... 53/376.7; 53/382.1; 53/458

(58) Field of Classification Search ..... 53/376.7, 53/382.1, 382.2, 382.3, 566, 458, 468; 493/116, 493/117, 316, 315, 127, 317

See application file for complete search history.

(56) References Cited

U.S. PATENT DOCUMENTS

| | | | | |
|---|---|---|---|---|
| 3,420,037 | A * | 1/1969 | Anderson et al. | 53/566 |
| 4,081,945 | A * | 4/1978 | Calvert et al. | 53/566 |
| 4,109,444 | A | 8/1978 | Lee | |
| 4,348,853 | A | 9/1982 | Morse et al. | |
| 4,537,649 | A * | 8/1985 | Ulrich et al. | 156/355 |
| 4,569,182 | A * | 2/1986 | Leuvering | 53/456 |
| 4,629,446 | A | 12/1986 | Focke | |
| 4,854,111 | A * | 8/1989 | Roberts et al. | 53/500 |
| 4,930,291 | A * | 6/1990 | Buisseau | 53/458 |
| 5,393,291 | A | 2/1995 | Wingerter | |
| 8,020,361 | B2 * | 9/2011 | Kobierzycki et al. | 53/564 |
| 2004/0226270 | A1 | 11/2004 | Smith | |

FOREIGN PATENT DOCUMENTS

| | | | |
|---|---|---|---|
| DE | 28 13 723 | A1 | 10/1978 |
| DE | 34 29 761 | A1 | 2/1986 |

* cited by examiner

*Primary Examiner* — Sameh H. Tawfik
(74) *Attorney, Agent, or Firm* — Sughrue Mion, PLLC

(57) ABSTRACT

A system having an upstream module M for storing cardboard blanks, a central module C with a device for taking the blanks from the magazine, and a downstream packing and packaging module V having a station where the blanks are erected. The extractor arm is mounted on a carriage which is movable so as to move the blanks lengthwise and the arm is movable relative to the carriage by an actuating mechanism which enables the arm to articulate about an axis. The distance D between the exit edge of the magazine and the reference point of the station is fixed, and the carriage controls the movements of the blank extracted from the magazine in order to avert the risk of interference with the magazine and to position the blank in the station to enable it to be erected, and this for a whole range of forms of blanks.

14 Claims, 9 Drawing Sheets

PACKING AND PACKAGING SYSTEM

FIELD OF THE INVENTION

This invention relates to installations for wrapping and packaging diverse and varied products such as flasks, bottles and the like.

It relates more specifically to the machine and the process that enable cardboard cutouts to be formed in order to produce the box blanks, then, after filling, the closed boxes containing the products concerned.

The invention relates to the arrangement of the various stations of this type of machine, namely:—the station for storing cardboard cutouts, or the storage site,—the station for forming cutouts that can, depending on the case, be expanded for filling the box blank and packaging products, and,—the station for picking up cutouts located between said storage site and said forming station, which pick-up station comprises special arrangements at the level of its extraction means which perform the movement of said cutouts between said storage site and said forming station.

DESCRIPTION OF THE PRIOR ART

The wrapping and packaging means generally comprise a "fifo"-type storage site, in which the cardboard cutouts are stored. These cutouts are picked up in the storage site one by one, by an extraction arm, and they are shaped in the form of box blanks for receiving products. These blanks are transformed into actual boxes after integration of the products.

In the case of "wrap-around"-type cutouts, the box is formed around the products to be wrapped, whereas in the "American box"-type cutouts, the assembly enables first a sheath to be produced, which sheath can then be filled with the products to be wrapped, and then closed.

These wrapping and packaging installations, also called boxing installations, are used in product preparing and packaging chains; they are also used in unpacking installations in order, for example, to produce a new packaging of the products that is better suited to the mode of distribution of the latter.

Regardless of their destination, these machines are often versatile, i.e. they can form cutouts of various formats and be used to wrap and package products of which the nature, shape and dimensions are highly variable.

This versatility of the machines means, at the various stations, arrangements enabling adjustments to be performed, such as, for example, guide spacing adjustments and reference point adjustments, for each type of cutout. These adjustment operations are to be performed everywhere, on the cutout passage line.

At the storage site, other adjustments can be implemented, such as the height adjustment of the soleplate in order to position the cutouts, according to their format, opposite the extraction means.

The intervention at the storage site in order to adjust the soleplate height disrupts the ergonomics of the machine, presenting an inconvenience and complications for the operators, and in particular for the person responsible for supplying said storage site.

These machines also have relatively large sizes and their integration in existing installations is sometimes complex. They also require sufficient space all around in order to be capable of circulating so as to enable, in particular, the storage site to be supplied with cutout packets.

The cutout pick-up operation, in the storage site, can also present problems due to the wide variety of formats.

The pick-up device can consist of one or two extractor arms that are equipped with suction cups. Generally, these arms are adapted to a very specific cutout format; moreover, they cannot grip the cutouts just anywhere. The suction cups for handling cutouts are in contact with a single side of the cutouts, the side used for the subsequent forming operation.

For certain cutout formats, the number of active suction cups can sometimes be inadequate and cause extraction failures with incidents.

SUMMARY OF THE INVENTION

This invention proposes means that enable the disadvantages of the current machines to be overcome.

Thus, the machine according to the invention enables the loading of cutouts in the storage site to be facilitated, and the ergonomics of said storage site to be optimized by offering the operator the option of depositing the cutouts, regardless of their dimensions, always at the same height.

This invention also enables the interleaving of different stations with one another and therefore enables the size of this type of machine to be optimized.

It also enables, by using a modular structure, machines with different characteristics in terms of speed and bulk, for example, to be proposed. These alternatives, in the machine design, are obtained by adjusting the position of the forming station with respect to the storage site, or the versatility of said forming station, i.e. its capacity to perform both the forming of the cutout and the filling of the blank thus obtained with the products to be packaged.

It also enables machines to be proposed that are capable of handling a very wide variety of cutout formats with maximum efficiency in terms of cutout extraction, i.e. it enables said cutouts to be extracted without failure.

In general, the invention enables all situations arising from user desires to be managed more easily, even if they involve a multitude of cutout and box formats, speeds, or the ground surface available for installing the machine.

The wrapping and packaging installation according to the invention includes a machine that consists of a plurality of modules:—an upstream module for storing cardboard cutouts, in the form of a "fifo"-type storage site,—a downstream module for forming or erecting, and for immediate wrapping and packaging of the products as well as for removing the boxes, in which said forming is performed in a repository of which the reference point corresponds in particular to the lower upstream edge of the box blank,—and, arranged between said two modules, a central module equipped with a device for picking up said cutouts in said storage site, which device itself consists of at least one extractor arm that is borne by a carriage, which carriage is mobile so as to longitudinally move the cutout extracted from said storage site and bring it to the forming station at the inlet of said downstream module, which extractor arm is connected to said carriage by means of a maneuvering mechanism suitable for pivoting around a virtual axis that is located, when said cutout is picked up and moved by said carriage, in a fixed horizontal plane that corresponds, within the cardboard thickness range, to both the plane of the soleplate of said storage site and to that of the bed of said forming station.

This design enables relatively simple but flexible machines to be proposed, i.e. machines that have beneficial capacities for assembling cutouts of which the formats may vary in significant proportions.

This design also enables a machine to be produced in which the distance between the edge of the storage site outlet and the reference point of the forming station is fixed, regardless of the range of cutout formats to be managed on said machine. The management of the positionings of the cutouts in the stationary repository of the forming station is performed by the carriage bearing the extractor arm, which carriage is mobile below the storage site, and its longitudinal movement, with each cutout, enables any risk of interference between the cutout and the storage site to be avoided, and said cutout to be properly positioned in the repository of the forming station.

This arrangement enables a storage site to be provided in which the soleplate is located at a constant level, corresponding to the conventional level of a worktable, for example. In addition, the distance between the storage site and the forming station can be minimized, enabling the bulk on the ground of the installation to be optimized as necessary.

The invention thus enables the use of such a machine, which, with its arrangements, has a truly universal character, to be uniquely simplified. This installation is indeed capable of receiving a very wide range of cutout and box formats without having to modify the position of the reference zones, such as that of the storage site soleplate.

The change in format is performed with minimal intervention on the upstream and downstream modules, where only the change in the cutout and box dimensions requires an adjustment of the lateral guides on the entire passage line for cutouts, blanks and boxes, i.e. the storage site, the forming station as well as the blank filling and closing station.

The variations in cutout formats, which ordinarily involves an adjustment of the storage site soleplate, are now managed automatically by the device for picking up each cutout, i.e. by the extractor arm and by the carriage, which can move the latter between said storage site and the forming station, so as to place each cutout, regardless of the format, in the stationary repository of said forming station.

According to another provision of the invention, the mechanism for maneuvering the extractor arm includes:

- a structure supporting said extractor arm, in the form of a deformable double parallelogram comprising two large sides that form a pair of connecting rods, which rods are pivotably connected to three small sides parallel to one another, which form segments of a circle, which segments are, for two of them, each borne by a crankshaft pivotably connected to the carriage by means of shafts that are parallel to the virtual axis of said extractor arm, and the third segment acts as a support for said extractor arm and rotates around said virtual axis.
- and means for causing said crankshafts to pivot and for imparting on said arm support a circular movement of which the amplitude enables said extractor arm to move from a position of picking up the cutout in the storage site to a position of depositing said cutout at the forming station, and the reverse.

Also according to the invention, the maneuvering mechanism is arranged on a plate that is borne by the carriage, which carriage is guided on slides or tracks secured to the chassis of the machine, and it is mobile below the storage site, by means of a suitable drive member of the belt servomotor, actuator or liner electric motor type.

According to another provision of the invention, in order to enable efficient extraction of all format types, the device for picking up cutouts in the storage site includes at least one extractor arm that is in the form of a support bar equipped with suction cups connected to one another, and said support bar comprises two circuits for activating said suction cups, which are connected to its ends, in which said circuits are moreover equipped with means enabling them to act together or separately, and said suction cups are equipped, entirely or partially, with three-way valves capable of enabling a maximum number of suction cups to be selected and implemented for the cutout extraction operation, and of isolating said circuits so as to enable the deactivation of the suction cup(s) to be bypassed for the forming of said cutout.

Also according to the invention, the suction cup support bar has a length of approximately the dimension of the largest cutout in the case of the "American box", and slightly lower in the case of the "wrap-around".

According to another provision of the invention, in the case of a machine designed to be capable of forming both "wrap-around" and "American box"-type cutouts, the carriage comprises, in addition to the extractor arm, a second mechanism for forming the "American box"-type cutout, which second mechanism is in the form of an adaptable instrument, and it consists of at least one forming arm that is pivotably connected to said carriage, which forming arm is capable of being moved by means of an actuator, for example, in order to go from an inactive position in which it is retracted below the level of the soleplate of the storage site to an active position in which it is located between said storage site and the erecting station, which forming arm comprises one or more suction cups for gripping the lower upstream side of the cutout when the latter is in the vertical position, spaced apart from said storage site.

Also according to the invention, and in the case of the "American box"-type cutout, the mechanism for maneuvering the extractor arm comprises members for actuating the latter, which consist of two actuators arranged side by side:

- a first actuator that simply moves said extractor arm from its resting position to its cutout handling position, and
- a second actuator that, after movement of the carriage, causes said extractor arm to pivot slightly, and moves the latter, with the cutout, to the vertical position, perpendicular to the soleplate of the storage site, so as to present the lower upstream panel of said cutout to the forming arm, which, once it is in position, enables said extractor arm to pivot about its virtual axis, assembling said cutout in the form of a sheath, in which said first actuator is placed between said second actuator and one of the crankshafts, and said second actuator is pivotably connected to the plate of the maneuvering mechanism, secured to said first actuator.

According to another provision of the invention, the assembly of the mechanism for maneuvering the extractor arm is arranged on a plate that is itself pivotably connected to the carriage, and in particular to a shaft parallel to the virtual axis of the extractor arm, which plate is capable of being moved by an actuator, for example, to enable said assembly, and in particular said extractor arm, to pivot so as to temporarily retract it below the level of the soleplate of the forming station and with respect to the box blank, before said carriage returns to its starting position.

Also according to the invention, the machine can be arranged according to the desired speeds and also according to the limits on its bulk; thus, it can comprise a station for forming each cutout which also acts as a filling station; this constructive arrangement enables a particularly compact installation to be used; however, in this configuration, it can also have a forming station that is located at such a distance from the storage site that it enables the passage of the extractor arm, which arm is carried by the carriage with the cutout extracted from the storage site in order to deposit said cutout at said forming station, and it is immediately retracted by the backward movement of the carriage in order to be capable of pivoting and returning to its active position for picking up the next cutout in the storage site.

According to an alternative, when only the speed takes precedence, the machine can comprise two separate stations: a forming station, followed by a filling station, so that, in such an arrangement, the return of the extractor arm can be performed immediately after the transfer of the box blank between said forming station and the filling station.

The invention also relates to the process for extracting and transferring a cardboard cutout arranged in the inclined outlet window of a horizontal "fifo"-type storage site, which process consists of:

bringing an extractor arm near in order to place its selected suction cups in contact with said cutout, moving said extractor arm with the suctioned cutout in order to bring the latter to the repository of the forming station, where only the necessary suction cups are kept active, and it also consists of:—performing the pivoting movement of said extractor arm, with said cutout, around a virtual axis that is located, within the cardboard thickness range, in the horizontal plane of the bed and in the plane of the bed of said forming station.

Also according to the invention, the cutout extraction and transfer process consists of performing, prior to the pivoting movement of the extractor arm around its virtual axis, or simultaneously, a longitudinal movement of said arm with respect to the storage site so as to avoid any interference between the cutout and said site, and in particular between the cutout brought by said extractor arm and the cutout ready to leave said storage site.

According to another provision of the invention, in the case of a "wrap-around"-type box cutout, in which the forming is performed at the corresponding station by folding its sides in a repository comprising a folding cam arranged upstream and projecting onto the soleplate of said forming station, at the level of the reference point, and a downstream stop located above said soleplate, at a level substantially higher than the thickness of the box, in which the extraction process, after the selection of the necessary suction cups, consists of:

initiating the operation of folding the lower side of the extracted cutout with respect to the upper adjacent side, by sliding said lower side on said cam, ending the erecting operation by wedging the corner formed by said sides of the cutout into the right angle formed by the straightening surface of said cam and by the soleplate of the forming station, which wedging is performed by means of a suitable movement of the carriage and the extractor arm.

Also according to the invention, but in the case of an "American box"-type cutout, the process for extracting and transferring the cutout for the assembling thereof consists of:

moving the extractor arm and the extracted cutout away from the edge of the outlet of the storage site soleplate, turning said extracted cutout so as to position it perpendicularly to the soleplate of the forming station, and, as necessary, spacing, simultaneously with the turning operation or not, said extracted cutout from said outlet of the storage site soleplate, by a distance sufficient to enable the forming arm to be inserted between said extracted cutout and said storage site, gripping the lower upstream side of said cutout by means of said forming arm in order to hold said lower side in place, perpendicularly to the bed of the forming station, selecting the suction cups of said extractor arm that are necessary for the forming of the cutout, pivoting, around its virtual axis, which coincides with the reference point, the extractor arm and the downstream side of said cutout suctioned by the suction cups of said arm, in order to erect said cutout by placing said suctioned downstream side on said soleplate of the forming station, in which said virtual axis coincides, within the cardboard thickness range, with the common edge of the two sides of said cutout.

BRIEF DESCRIPTION OF THE DRAWINGS

However, the invention will be further detailed in the following description with the appended drawings, provided for indicative purposes, in which.

DETAILED DESCRIPTION OF THE INVENTION

Figure 1:
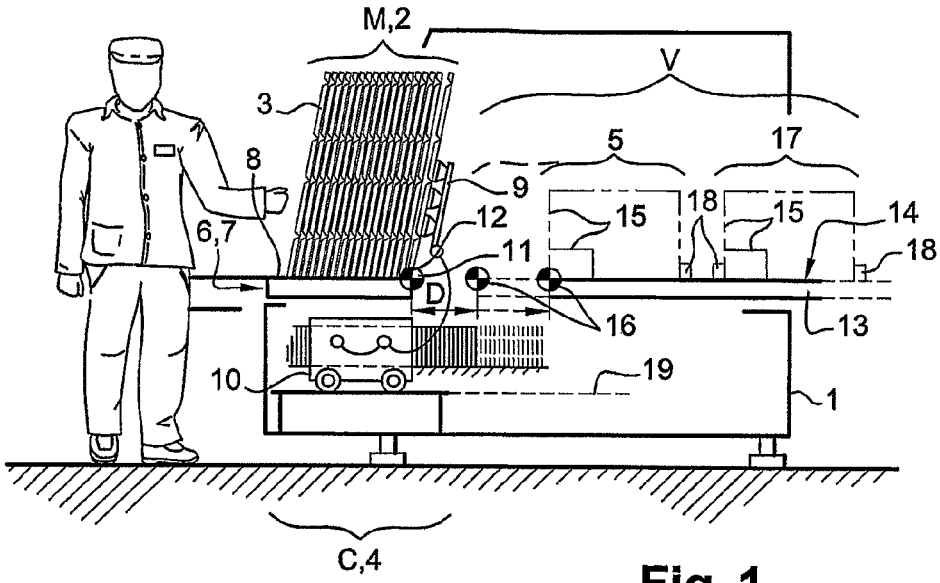
FIG. 1 is an elevation drawing of a machine according to the invention, intended for an installation for wrapping and packaging various products.

FIG. 1 is an elevation drawing of an embodiment of the machine for wrapping and packaging diverse and varied products such as flasks, bottles, and bags, which machine is comprised of an assembly of a plurality of modules on a general chassis 1, and in particular:—an upstream module M forming the storage station, or storage site 2, for the cutouts 3,—a central module C that comprises the pick-up device 4 and—a downstream module V that includes a plurality of stations, and first the station 5 for forming the cutout 3.

Figure 3:
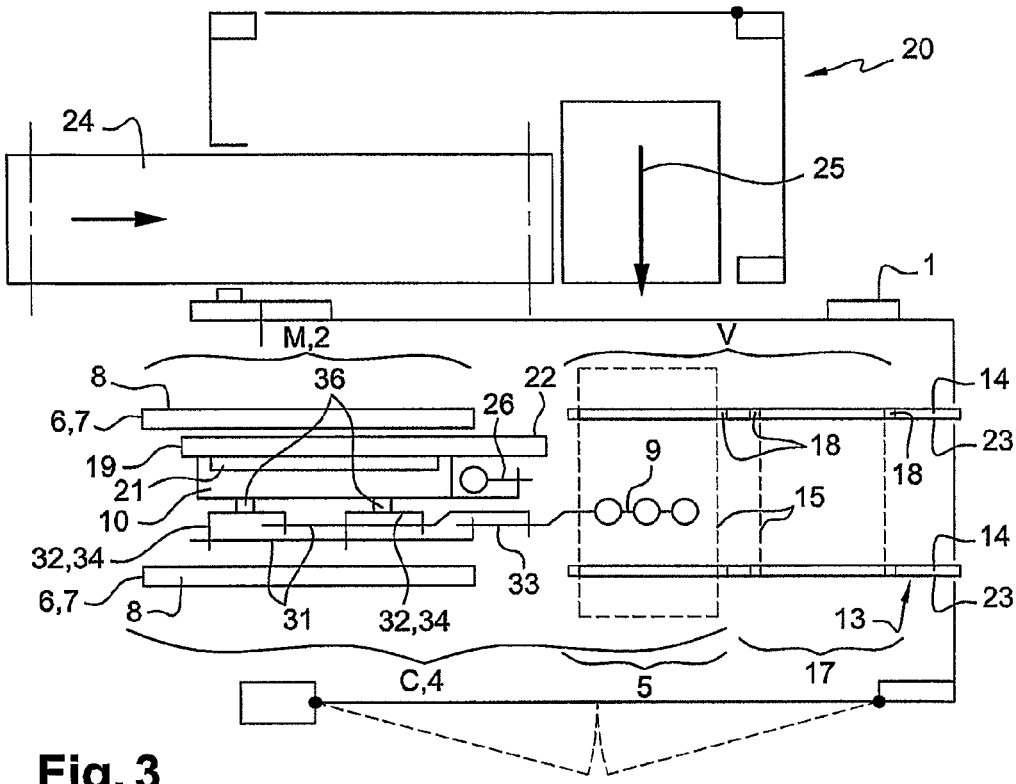
FIG. 3 is a top view of the installation with a machine corresponding to that of FIG. 1.

The packets of cutouts 3 are deposited in the storage site 2, which is of the "fifo" type. In this storage site 2, the cutouts 3 are inclined downstream, by some ten degrees, and they rest on a conveyor 6 formed, as shown in FIG. 3, by two lateral plates 7 that act as a soleplate 8 for said cutouts 3.

The conveyor 6 and its plates 7 are secured to the chassis 1. The soleplate 8 is horizontal and stationary with respect to the chassis 1, therefore stationary with respect to the ground.

The cutouts 3 are deposited onto the soleplate 8 of the storage site 2 by the operator at a constant level, on the order of 85 cm from the ground, i.e. an ergonomically sound level.

The central module C includes the device 4 for picking up cutouts 3, which is arranged at the outlet of the storage site 2; this device 4 consists in particular of—at least one extractor arm 9 of the type with suction cups, which enables said cutouts to be picked up and moved in order to position them at the forming station 5 and—a carriage 10 bearing said extractor arm 9.

The extractor arm 9 is borne by the carriage 10 by means of a maneuvering mechanism that will be discussed later in particular in relation to FIG. 4 and the following figures.

The carriage 10 is arranged below the level of the soleplate 8 of the storage site 2 and it is guided and moved by suitable means, which will so be discussed later.

To reduce the minimize the amplitude of the movements of the extractor arm 9, the latter pivots about an axis 11 that is located both in the plane of the soleplate 8 of the storage site 2 and the soleplate of the forming station 5 with the possibility, when it picks up the cutout 3 in the storage site 2, of pivoting around its axis 11, which coincides, within the cardboard thickness range, with the edge 12 of the outlet of said soleplate 8 of said storage site. This axis 11 has the particular characteristic of being virtual, as described below in relation to FIG. 4, in particular.

The downstream module V includes a conveying system in the form of a conveyor 13, of which the upper receiving surface acts as a soleplate 14 for the forming station 5, which soleplate 14 is located, within the cardboard thickness range, in the extension of the soleplate 8 of the storage site 2.

This conveyor 13 is arranged to receive the cutout 3 brought by the extractor arm 9 and to enable said cutout to be formed, or erected, in the form of a box blank 15, in a suitable repository that is provided at the forming station 5; the extreme models of box blanks 15 are shown for indicative purposes.

The conveyor 13 and its environment are also arranged to enable the box blank 15 to receive its load, i.e. the products to be wrapped.

The repository for assembly of the cutout 3 is located at the inlet of the forming station 5, on the conveyor 13, and it comprises a marked reference point 16 that corresponds to the lower upstream edge of the box blank 15, regardless of the type of box. This reference point 16 is located at a distance D from the edge 12 of the outlet of the storage site 2, which can be chosen according to the desired machine type.

Two reference points 16 were placed on the soleplate 14 to show the possible alternatives with this type of machine. For a very compact machine, the point 16 is at a distance D from the edge 12, which is as small as possible.

If higher speeds are preferred, the distance D will be greater, approximately the length of the extractor arm 9 so that, after having deposited the cutout at the station 5, the arm 9 is retracted below the level of the soleplate 14 and moves backward, carried by the carriage 10, passing below the blank 15, in order to return to the active pick-up position, without waiting until the end of the operation of filling said blank 15 and the transfer thereof to the pressing station 17.

In the embodiment of the machine shown in FIG. 1, the operation of assembling the cutouts 3 and filling the blanks 15 is performed in the same location, at the forming station 5; after filling, said blank 15 is closed and sealed at a pressing station 17 to become a real box.

The transfer of the blank 15 from station to station is performed by means of the conveyor 13; the blanks 15 are held by suitable means of the cleat type 18 distributed regularly over said conveyor 13.

The distance D between the edge 12 of the outlet of the soleplate 8 of the storage site 2 and the reference point 16 of the forming station 5 corresponds only to a portion of the movement of the cutout 3 between said storage site 2 and said handling station 5.

In the case of a compact machine, the carriage first performs a going movement, in the downstream direction, to move the extracted cutout 3 away from the storage site 2, and then a return movement, in the upstream direction, to bring and wedge the cutout, while forming it, in its repository at the forming station 5.

The movement of the carriage 10 is performed by means of a drive member of the actuator type or of the servo-motor-driven belt type. It can also, as shown in the figure, be performed by means of an electric motor of the linear motor type.

The carriage 10 is guided by means of tracks or slides 19, which are secured to the general chassis 1 of the machine, and the motor, diagrammed in FIG. 1, will be described in detail below, in particular in reference to FIG. 3.

The linear motor is highly suitable for the movements of the carriage 10, which must be quick and precise. A linear motor does not intrinsically comprise mobile parts; it does not require any maintenance and it is particularly compact, enabling it to be positioned below the storage site 2.

The movements of such a carriage 10 are managed by means of control software that is adapted directly to the types and formats of the cutouts 3.

Figure 2:
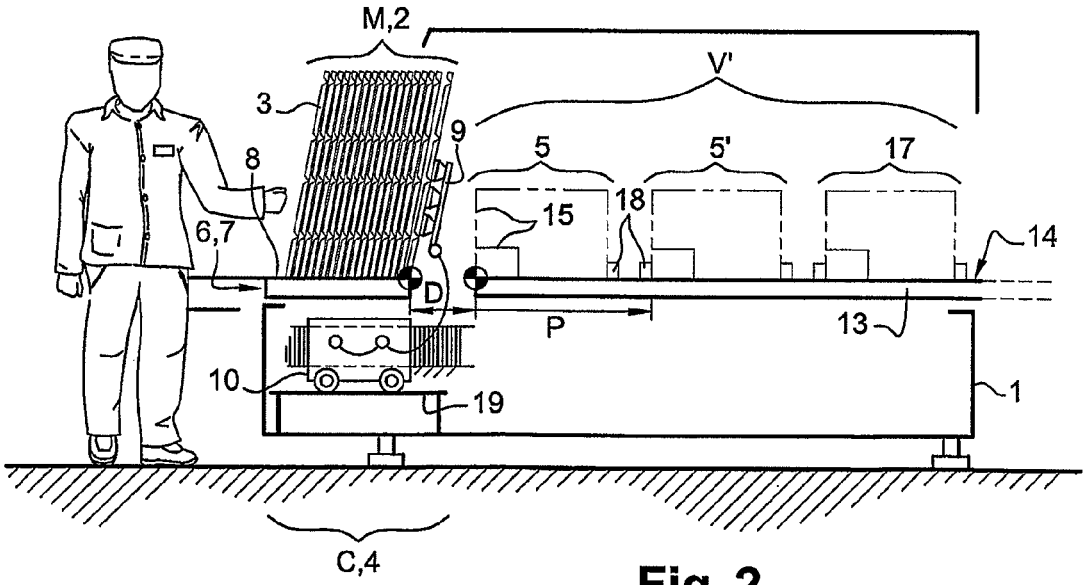
FIG. 2 is an elevation drawing of the machine according to an alternative embodiment of the invention.

FIG. 2 shows an alternative embodiment of the machine according to the invention, which enables operation at even higher speeds than in the case of the previous embodiment.

This machine in fact comprises a downstream module V', which is equipped with an additional station 5' where the blank 15 is filled. This station 5' is simply a division of the forming station 5 in order to separate the operations of erecting the cutout 3 and filling of the box blank 15. This additional station 5' is therefore located between the forming station 5 and the pressing station 17; it is offset downstream, with respect to the station 5, by a distance P enabling the passage of the extractor arm 9, which extractor arm 9 can indeed be brought to its active position for picking up a new cutout as soon as the cutout 3 has been erected then transferred by the conveyor 13 to the filling station 5'.

The bulk of this machine, shown in FIG. 2, is slightly greater than that of the machine shown in FIG. 1; the difference in length corresponds at least to the length of the extractor arm 9 and it is visible at the level of the conveyor 13, which is slightly longer than in the case of FIG. 1. This difference in length P corresponds to the step of movement of the blanks 15, then the boxes, on the conveyor 13, i.e. the step of the cleats 18 arranged on said conveyor 13.

This modular design enables a machine corresponding to user needs to be produced more easily and faster. Each machine has its own characteristics in terms of speed and cutout 3 format ranges; the implementation and maintenance thereof is largely simplified.

FIG. 3 is a top view of the wrapping and packaging installation; this installation includes the machine shown in FIG. 1, with, in addition, auxiliary equipment 20; this equipment consists essentially of a conveyor system that brings the products to be packaged and enables them to be inserted into the box blank 15 that has just been shaped at the forming station 5.

The machine is shown with its general chassis 1 and its various modules:

the module M which forms the storage site 2;

the module C which comprises the cutout pick-up device 4;

and the module V which comprises the handling station 5.

The storage site 2 is formed, as indicated above, by the two plates 7 that are, for example, each equipped with a powered endless chain in order to advance the cutouts 3, which chains act as a soleplate 8.

The pick-up device 4 is arranged on the carriage 10, which carriage 10 is located below the storage site 2 and it is guided horizontally on the tracks or slides 19 secured to the chassis 1. The carriage 10 is, for example, equipped with a linear motor; the primary winding 21 of said linear motor is arranged on said carriage 10 with an ad hoc electrical power supply, and the secondary winding 22 is associated with the tracks or slides 19, which secondary winding 22 consists of magnets.

The downstream module V consists of the conveyor 13, which serves to transfer the blanks 15 and the boxes; this conveyor consists of two plates 23 each equipped, for example, with a powered endless chain, which chains are equipped with cleats 18 for driving said blanks 15 and boxes from the forming station 5 to the outlet of the machine.

The space between the two plates 23, at least in their upstream portion, is free in order to enable the extractor arm 9 to pass when it goes from its position of picking up a cutout 3 in the storage site 2 to its position of depositing said cutout at the forming station 5, i.e. on the soleplate 14, which is formed by the conveyor 13.

On the side of the machine, the auxiliary equipment 20 conventionally includes a conveyor 24 that extends longitudinally, parallel to the direction of forward movement of the cutouts 3 in said installation. At the end of the conveyor 24, a push member, shown by an arrow 25, inserts the products into the box blank 15, which is waiting at the forming station 5. Once it is filled, as indicated above, the blank 15 is moved by the conveyor 13 through the pressing station 17 in order to finish and close the box.

The auxiliary equipment 20 arranged laterally in order to bring the products to be packaged is the same for the machines shown in FIGS. 1 and 2; in the case of FIG. 2, it is simply offset in the downstream direction by the distance P; i.e. it is placed at the level of the filling station 5'.

Figure 4:
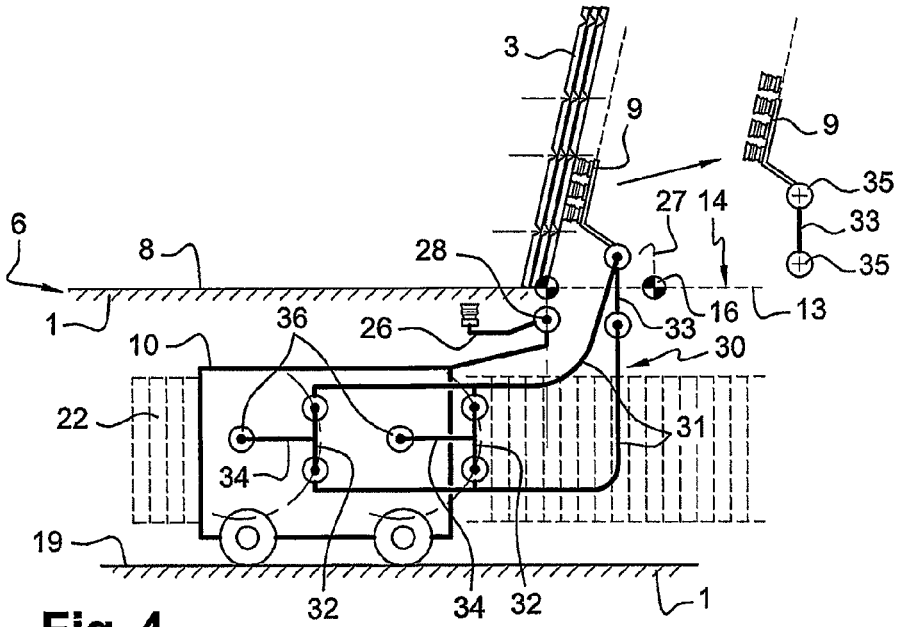
FIG. 4 diagrammatically shows the device for picking up cutouts in the storage site.

FIG. 4 shows, in greater detail, the pick-up device 4 mentioned earlier.

The figure shows the carriage 10, which is guided on the track or slide system 19, the extractor arm 9, which will be described in detail below, and, in addition, a system for temporary handling of a side of the cutout 3, which system consists of at least one second arm 26, which contributes to the forming, or erecting, of said cutout 3 at the level of the forming station 5.

In fact, this erecting arm 26 is a sort of complementary instrument for assembling "American box"-type cutouts 3, and this erection is performed by a combined use of the two arms 9 and 26 as described in detail below, in reference to FIGS. 16 to 21.

For the erecting of "wrap-around"-type cutouts 3, things are different because the arm 9 cooperates in particular with a cam 27, which is located at the inlet of the forming station 5 and in particular at the level of the reference point 16, as described in detail below in reference to FIGS. 11 to 15.

The arm 26, which is used to assemble "American box"-type cutouts 3, is pivotably connected directly to the carriage 10, by means of a shaft 28, while the extractor arm 9 is secured to said carriage 10 by means of a maneuvering mechanism 30. The arm 26 will be described in detail below.

The mechanism 30 for maneuvering the extractor arm 9 includes: —a structure supporting said arm 9, which is capable of causing the latter to pivot, and—means for moving said supporting structure.

The supporting structure of the arm 9 is in the form of a deformable parallelogram consisting of two large sides that are pivotably connected to three small sides, which are equal and parallel to one another. The two large sides form connecting rods 31 of which a portion is horizontal, parallel to the soleplate 8 of the storage site 2, and the other portion, extending in the downstream direction, is curved upward. The three small sides form segments of a circle that have the same diameter. Two segments 32 are each secured to a crankshaft 34 and form, with the connecting rods 31, a parallelogram; the third segment acts as a support 33 for the extractor arm 9 and it forms, with one of the segments 32 and said connecting rods 31, another parallelogram that is in the extension of the first. The two segments 32 are located below the level of the soleplate 8, upstream of the support 33.

This extractor arm 9 and its support 33 are shown separately, and they are described in detail below in reference to FIGS. 6 to 10. They can be in the form of a one-piece part with two bearings 35 arranged at the ends of said support 33, which bearings 35, shown separately, cooperate with the downstream ends of the connecting rods 31.

The crankshafts 34 are pivotably connected to the carriage 10 around shafts 36 that are parallel to the virtual pivot axis 11 of the extractor arm 9.

The means enabling the arm 9 supporting structure to be moved consist of a drive member of the actuator type, not shown in the figure, which actuator causes the rotation movement of the crankshafts 34 and the rotation movement of the support 33 of the extractor arm 9, by means of the two connecting rods 31; this movement of the crankshafts 34 is limited to around a quarter of a circle.

The support 33 pivots around the virtual axis 11 in order to cause the extractor arm 9 to move from its pick-up-extraction position to its depositing position at the forming station 5. This pivoting also enables the cutout 3 to be folded for erecting of same, in its repository, using the cam 27, in the case of a "wrap-around"-type cutout 3.

This erecting of the "wrap-around"-type cutout will be shown below in reference to FIGS. 11 to 15.

The maneuvering mechanism 30 is also shown in FIG. 3, in a diagrammatic top view.

The carriage 10 includes pivot shafts 36 of the crankshafts 34, which crankshafts 34, with their segment 32, have connecting rods 31, which themselves, at their downstream end, bear the support 33 of the extractor arm 9. It also includes the forming arm 26, which is pivotably connected to the carriage 10.

These extractor arms—arm 9, as well as arm 26—are led to handle cutouts of various formats. They must therefore be proportional, especially the extractor arm 9.

In addition, the suction cups of these arms 9 may fall opposite orifices, such as, for example, orifices acting as handles, both for "wrap-around"-type cutouts and for "American box"-type cutouts.

Figure 5:
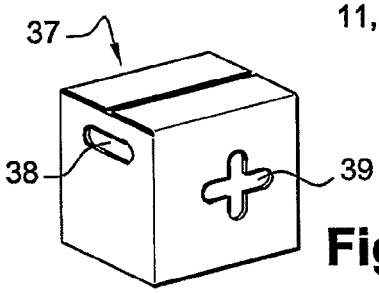
FIG. 5 shows a box provided with openings on its lateral walls, such as, for example, handles and/or one or more windows.

Thus, for example, FIG. 5 shows a box 37 that comprises handles 38 and one or more windows 39. Opposite these orifices, the suction cups of the arms are ineffective, and, moreover, they reduce the efficacy of the other suction cups due to the leakage that they generate.

To grip, extract and move the cutouts, without failure, the arms have a length that is, for example, adapted to the largest dimensions of the largest cutout 3 or box format, with, for arm 9 primarily, a large number of suction cups.

Figure 6:
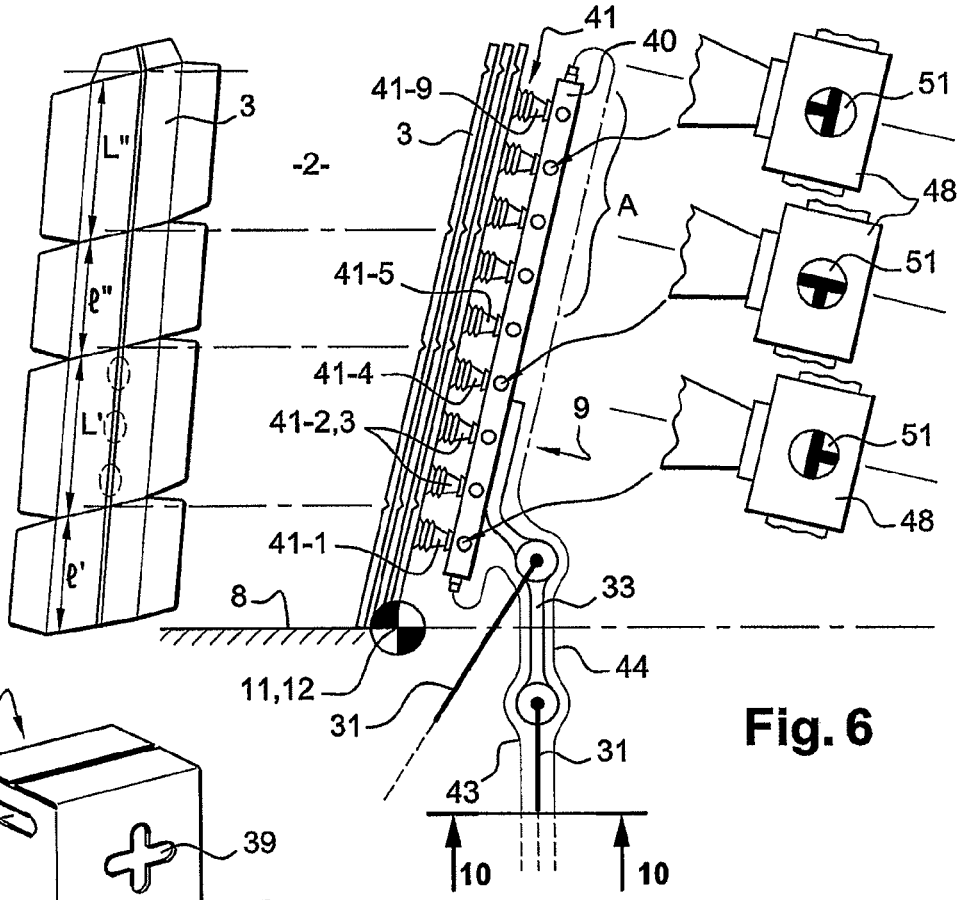
FIG. 6 shows an extractor arm and shows the activation of the suction cup valves for extraction and forming of "wrap-around"-type cutouts.

FIG. 6 shows an extractor arm 9 that is arranged specifically to adapt to the various types of cutouts 3; this arm 9 is a sort of universal arm.

Figure 7:
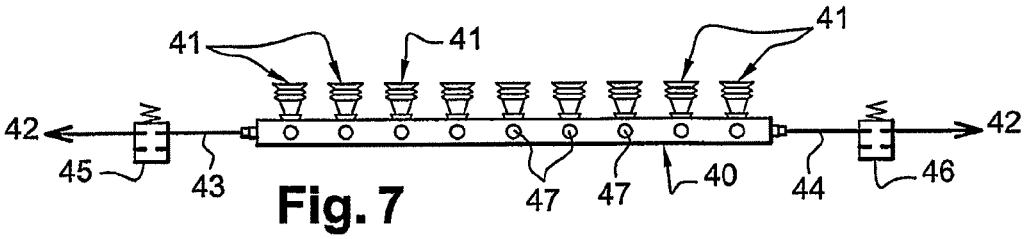
FIG. 7 shows an extractor arm with suction cups, in the form of a bar, provided with means for selecting the suction cups that will be active for the extraction operation, and then during the cutout forming operation.

This arm 9 includes a support 40 that is equipped with suction cups 41. This support 40, shown in isolation in FIG. 7, is in the form of a bar, and its length can correspond to the dimension of the cutouts 3. This length can correspond to the dimension of "American box"-type cutouts, and it can be slightly lower for a "wrap-around"-type cutout.

This support bar 40 has the special feature of being connected to the vacuum source 42, at the level of each of its ends by circuits 43, 44, which are separate. The circuits 43 and 44 comprise distributors 45 and 46, respectively, of the open-center type, which enable the suction cups 41 to be supplied or vented, and, moreover, each suction cup 41 comprises its own valve 47 of the three-way valve type. These valves 47 enable, in particular, each suction cup 41 to be isolated and/or selected, and, in addition, enable the circuits 43 and 44 to be separated, forming a sort of mobile partition.

Figures 8, 9:
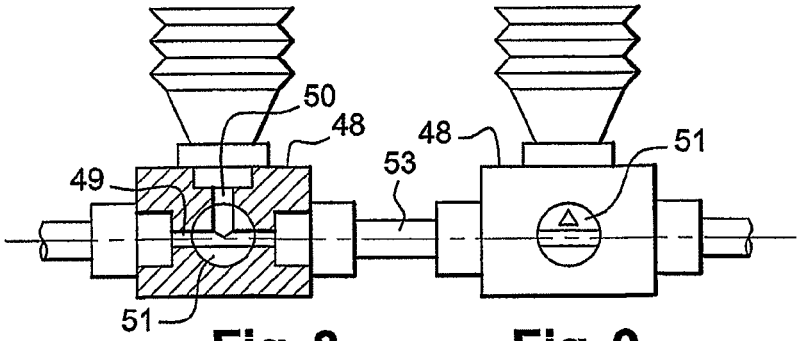
FIG. 8 is a partial cross-section of the suction cup bar at the level of one of the suction cups to show the three-way valve.
FIG. 9 is an external view of the bar, at the level of the valve.

These valves 47 are arranged at the level of each suction cup 41, which comprises, as shown in FIGS. 8 and 9, a body 48 that acts as a three-way valve. This body 48 is traversed by a conduit 49 and comprises a transverse conduit 50 that supplies the actual suction cup. The supply to the suction cup is carried out by means of a ball 51 that is housed in the body 48. This ball 51 is arranged to enable three possibilities:

supply the suction cup, bypass the suction cup, close the conduit 49 while supplying the suction cup, i.e. isolating the circuits 43 and 44 from one another.

The ball 51 is maneuvered very simply, with a screwdriver, for example, that is engaged in the slot 52, as shown in FIG. 8. An indicator, in the form of an arrow, shows the operator the direction of the ball 51.

The suction cups 41 are connected to one another by pipes 53 and are secured to the support bar 40, which forms the extractor arm 9. The support bar 40 can also support a plurality drilled blocks, which in turn comprise a plurality of suction cups; it can even consist of a single simple bar that is drilled over its entire length and on which the various suction cups are implanted directly.

The arm 9 enables the cutouts 3 to be picked up in the storage site 2, and, in particular, as shown in FIG. 6, "wrap-around"-type cutouts; this extraction is performed with maximum efficacy because said arm grips said cutout over a large portion of its height.

This type of cutout 3, as shown at the inlet of the storage site 2, therefore comprises a plurality of sides that are marked $\ell'$, $\ell''$,L' and L", as well as flaps on each side and the adhesive tongue.

As shown in FIG. 6, the arm 9 can have suction cups 41 in contact with a plurality of sides of the cutout 3 in order to perform the extraction. Not all of the suction cups 41 are operational; they are operational according to the position of the ball 51, as shown in FIG. 6.

In this FIG. 6, the suction cup 41-1, which is placed on the $\ell'$side, is bypassed; it is deactivated in order to extract cutout 3, especially so as not to interfere with the folding of this $\ell'$side during the erecting of said cutout.

Also in this example, the suction cups 41-2 and 3 are active, as are suction cups 41-5 to 9, and suction cup 41-4 is also active.

It is at the level of said suction cup 41-4 that the separation of the two supply circuits 43 and 44 takes place in order to enable, after extraction of the cutout, the deactivation of the suction cups 41-5 to 9; this deactivation of the suction cups 41-5 to 9 is essential in order to carry out the erecting.

The operator intervenes, when changing the cutout 3 formats, on the various valves 47, and in particular the balls 51, in order to active and/or deactivate the suction cups 41 and in order to form two suction cup zones: a zone A, which is assigned only to the extraction of cutouts 3 and a zone corresponding to the L' side of said cutouts and which is assigned both to the extraction and the erecting of said cutouts.

The activation of the two zones is performed automatically by acting on the distributors 45 and 46; the two distributors 45 and 46 simultaneously supply all of the suction cups 41 for the cutout extraction operation, and then the distributor 46, for example, opens the circuit 44 and deactivates suction cups 41-5 to 9, freeing the sides of the cutout 3, which will be folded, as described in detail below in reference to FIG. 11.

The two circuits 43 and 44 that supply the suction cups 41 consist of pipes that accompany the arm 9 in its movement.

Figure 10:
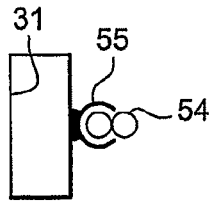
FIG. 10 is a sectional view of a connecting rod for maneuvering the extractor arm, showing the suction cup supply circuit installation system.

FIG. 10 is a sectional view of the connecting rod 31 and the circuits 43 and 44 combined in a single pipe 54. This pipe 54, which is a double pipe, is snapped into a clamp 55, which is itself secured to the connecting rod 31. This assembly has the advantage of being simple; it also enables the pipe 54 to be installed so that it corresponds with the neutral axis of the path going from the connecting rod 31 to the arm 9, passing through the support 33. Its deformation is thus better controlled; it is more regular, and the risks associated with friction with other parts are eliminated.

Figure 11:
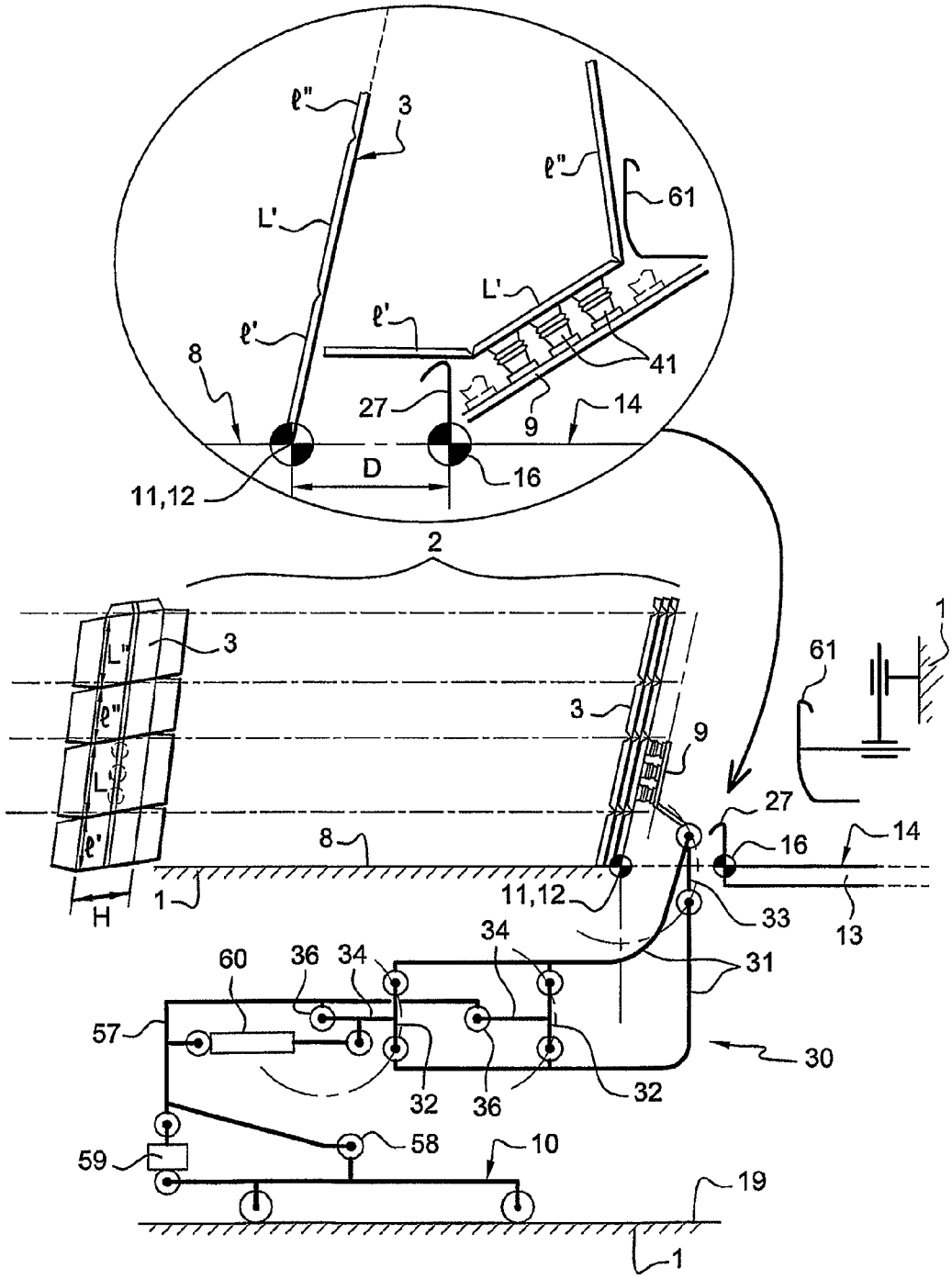
FIG. 11 shows, in the form of a functional diagram, the device for picking up cutouts in order to form "wrap-around"-type boxes.

FIG. 11 shows, in a more comprehensive functional diagram, the pick-up device 4 that manipulates the cutouts 3 arranged in the storage site 2 and in particular "wrap-around"-type cutouts.

This pick-up device includes the mechanism 30 for maneuvering the extractor arm 9, which is placed between the latter and the carriage 10, as detailed above. This maneuvering mechanism 30 is in fact implanted on a structure that will be described as a plate 57 in the text below. This plate 57 is secured to the carriage 10 by means of a pivot shaft 58 and by means of an actuator 59 of which the forms and functions will be described in detail below in reference to FIGS. 15 and 21.

The pivot shafts 36 of the crankshafts 34 are arranged on the plate 57, and an actuator 60 is placed between the latter and one of said crankshafts 34 in order to move the connecting rods 31, and, consequently, move the support 33 of the extractor arm 9.

This extractor arm 9 carries the cutout 3 picked up at the outlet of the storage site 2 in order to form it in cooperation with the cam 27, discussed above, and with a stop 61, which is secured to the general chassis 1 of the machine, and which is adjustable with respect to the latter according to the format of the cutouts 3.

The process of forming a cutout 3 is described in relation to a cutout model 3 of the conventional "wrap-around" type, as shown at the inlet of the storage site 2; this cutout 3 comprises, as described earlier, a plurality of sides that are marked $\ell'$, $\ell''$,L' and L"; it also comprises flaps and an adhesive tongue.

The separate detail of FIG. 11 shows, in greater detail, one of the steps of the process of forming the cutout 3 by means of the extractor arm 9. The cutout 3 is folded on the cam 27 and on the stop 61; a dihedral is formed between sides $\ell'$,and L' and another dihedral is formed between sides L' and $\ell''$..

To be capable of carrying out this forming operation, the suction cups 41 of the arm 9 have been selected, activated and deactivated as described above, in reference to FIG. 6 in particular.

One will also note, in this detail, the distance D between the edge 12 of the outlet of the storage site and the reference point 16 where the cam 27 is located; this distance is greater in FIG. 11 than in FIGS. 12 to 15 for the sake of clarity of the drawings.

Figure 12:
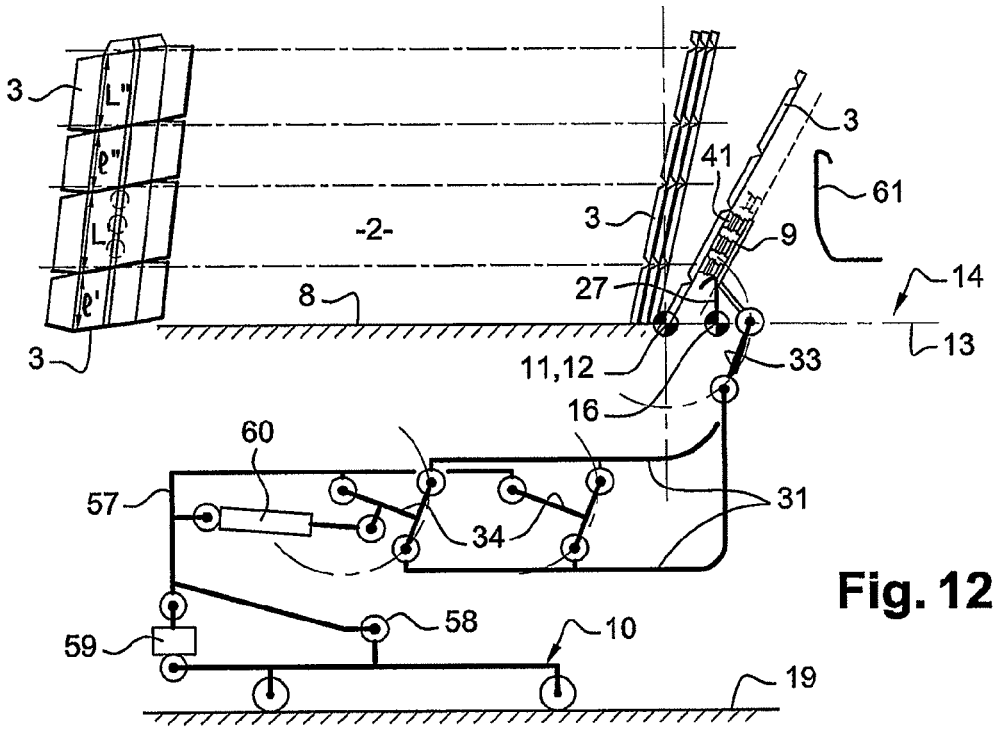
FIGS. 12 to 15 diagrammatically show the various steps of a cutout extraction operation and the erecting of the cutout in the form of a "wrap-around"-type box.

For the forming operation, in FIG. 12, the cutout 3 extracted from the storage site 2 is pivoted by the extractor arm 9, which pivots around its virtual axis 11. This movement is performed by means of the actuator 60, which causes the crankshafts 34 to pivot and which, by means of the connecting rods 31 of the double parallelogram, causes the support 33 of the extractor arm 9 to pivot around the virtual axis 11.

Figure 13:
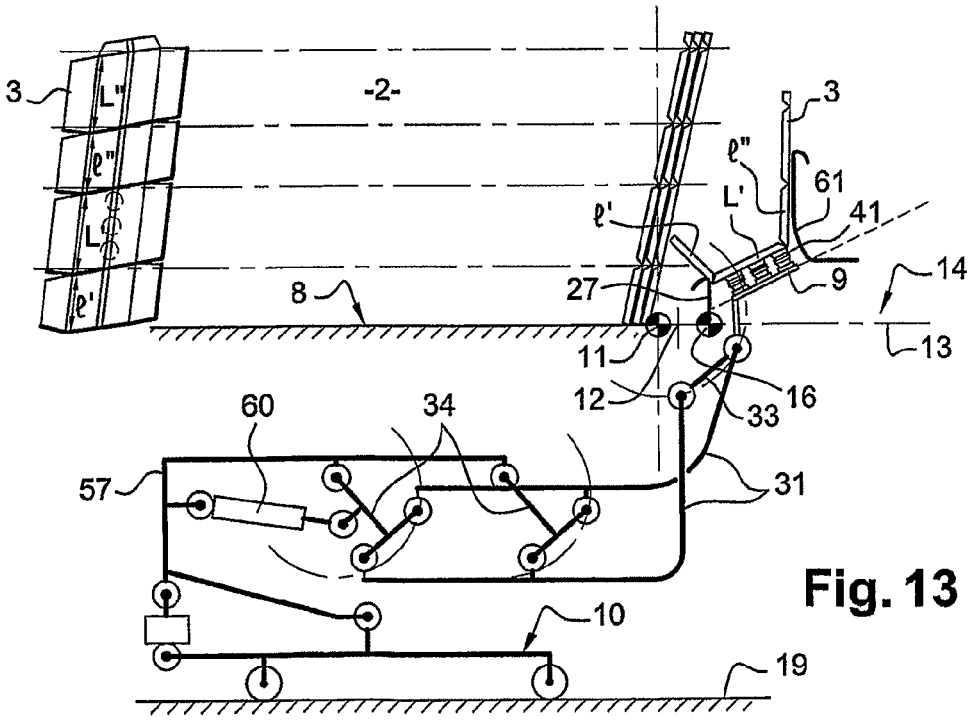

To avoid any interference between the extracted cutout 3 and the storage site 2, the carriage 10 moves and separates the extractor arm 9 and the cutout 3. The pivoting and longitudinal displacement movements can of course be combined, and, as shown in FIG. 13, the cutout 3 is formed with the assistance of the cam 27 and the stop 61. The lower side $\underline{\ell}$ comes into contact with the cam 27 and is folded with respect to side L', which is driven by the movement of the arm 9, suctioned by the suction cups 41 of the latter.

Similarly, side $\underline{\ell'}$ comes into contact with the stop 61 and a second fold is formed between L' and $\underline{\ell'}$.

Figure 14:
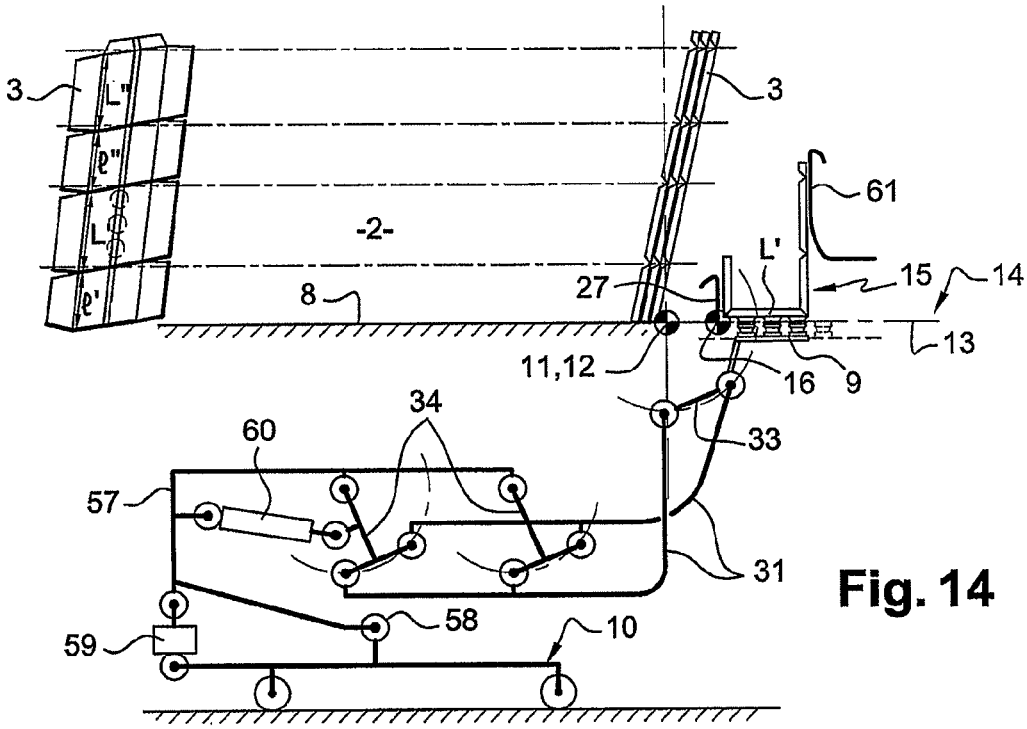

The carriage 10 is moved forward very slightly in the downstream direction in order to avoid any risk of interference, but one will note in FIG. 14 that it returns to its initial position in order to wedge the cutout 3 in the repository, i.e. in the angle of the cam 27 that corresponds to the reference point 16 mentioned above. This course of the carriage 10 is extremely slight, but it must be precise.

Figure 15:
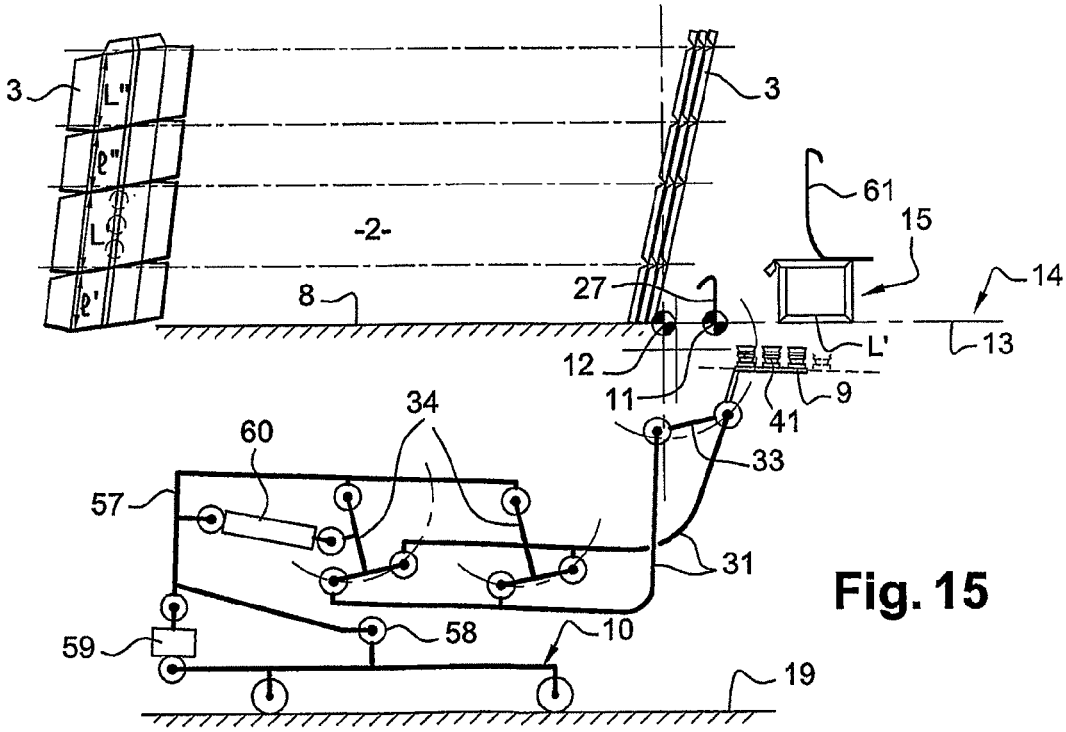

When the cutout 3 is properly positioned at the assembly station 5 and it takes the form of a box blank 15, the extractor arm releases 9 said blank and it is retracted downward so as not to interfere with the movement of the latter, as shown in FIG. 15.

The release of the cutout 3 at the station 5 is performed by deactivating the suction cups 41 in a conventional manner; however, the retraction of the extractor arm 9 below the level of the soleplate 14 is performed by means of a pivot of the plate 57, and, consequently, any pick-up mechanism. Indeed, the plate 57 is secured to the carriage 10 by means of the pivoting connection 58 and it is capable of being moved by the actuator 59, which is placed between said plate 57 and said carriage 10.

The amplitude of the movement is relatively low, but sufficient to avoid any interference between the suction cups 41 of the extractor arm 9 and the L' side of the box blank 15. This retracted position is held during the operation of filling the box blank 15, which has just been shaped at the forming station 5. When the blank 15 has received its batch of products, it is moved by the conveyor 13; once the repository of the station 5 is free, the arm 9 returns to its position for picking up a new cutout 3 in the storage site 2 and the cycle can be repeated.

It is easy to imagine the benefit of quickly freeing the passage of the extractor arm 9 in order to enable it to return to the storage site 2 and pick up a new cutout 3 to be extracted during the operation of filling the box blank 15 with its batch of products, at the assembly station 5. This possibility is offered with the machines shown in FIGS. 1 and 2, described above.

The machine shown in FIG. 1 combines, at the same station 5, the forming of the blank 15 and the filling of said blank. The distance D between the edge 12 of the outlet of the storage site 2 and the reference point 16 at the inlet of the forming station 5 can be chosen so as to enable the extractor arm 9 to return during the blank 15 filling operation.

The forming station 5 can be located at a distance D from the storage site 2, which corresponds to the radius of the circle covered by the extractor arm 9; this distance D can even be slightly smaller than said radius owing to the movement of the carriage 10, which can bring the virtual axis 11 of said arm 9 upstream of the edge 12 of the outlet of the soleplate 8 of the storage site 2.

Once the cutout 3 has been picked up, the extractor arm 9 is moved by the carriage 10 in order to bring said cutout 3 into the repository of the forming station 5, and then, once the blank 15 has been formed, it is handled by the cleats 18 of the conveyor 13 so that said extractor arm 9 can be detached from said blank 15 and move backward with the carriage 10 in order to return to the active pick-up position.

The distance D is chosen according to the desired characteristics of the machine. If the compactness of the machine is critical, the distance D will be as short as possible; if speeds are most important, while still minimizing the bulk, the distance D will be approximately the length of the extractor arm 9, i.e. approximately the radius of the circle of coverage.

FIG. 2 shows an alternative embodiment of the machine, which includes a separate station for filling blanks 15. This station 5' is located downstream of the forming station 5, at a distance P, which corresponds to the step of the cleats 18 arranged on the conveyor 13. This distance P is greater than the length of the extractor arm 9. In this particular case, the longitudinal movement of the extractor arm 9 is relatively low; it is the blank 15 that is moved once it has been shaped at the forming station 5, brought by the conveyor 13 to the filling station 5'. Once the forming station 5 is free, the extractor arm 9 can pivot in order to pick up a new cutout 3.

This arrangement of the machine, shown in FIG. 2, enables a machine to be provided which operates at high speeds but which has a greater bulk than the machines described above in reference to FIG. 1.

The different arrangements of the machines are applicable both to "wrap-around"-type cutouts and to "American box"-type cutouts.

Figure 16:
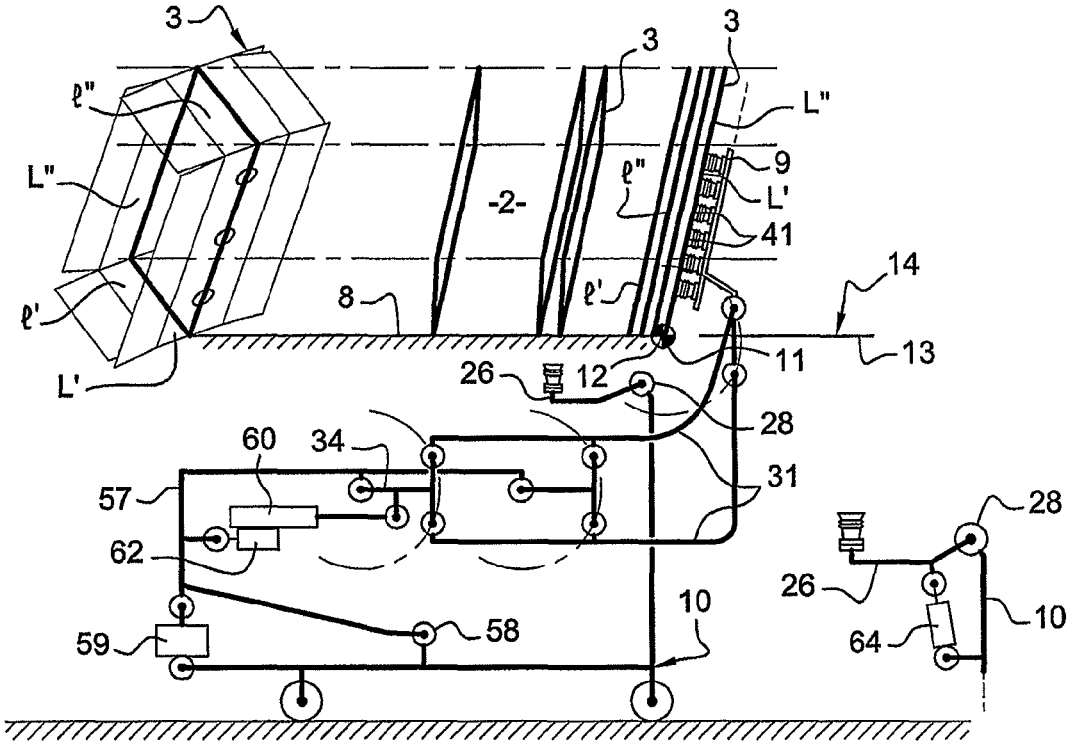
FIG. 16 shows, in the form of a functional diagram, the device for extracting cutouts in order to form so-called "American box"-type boxes.
Figure 17:
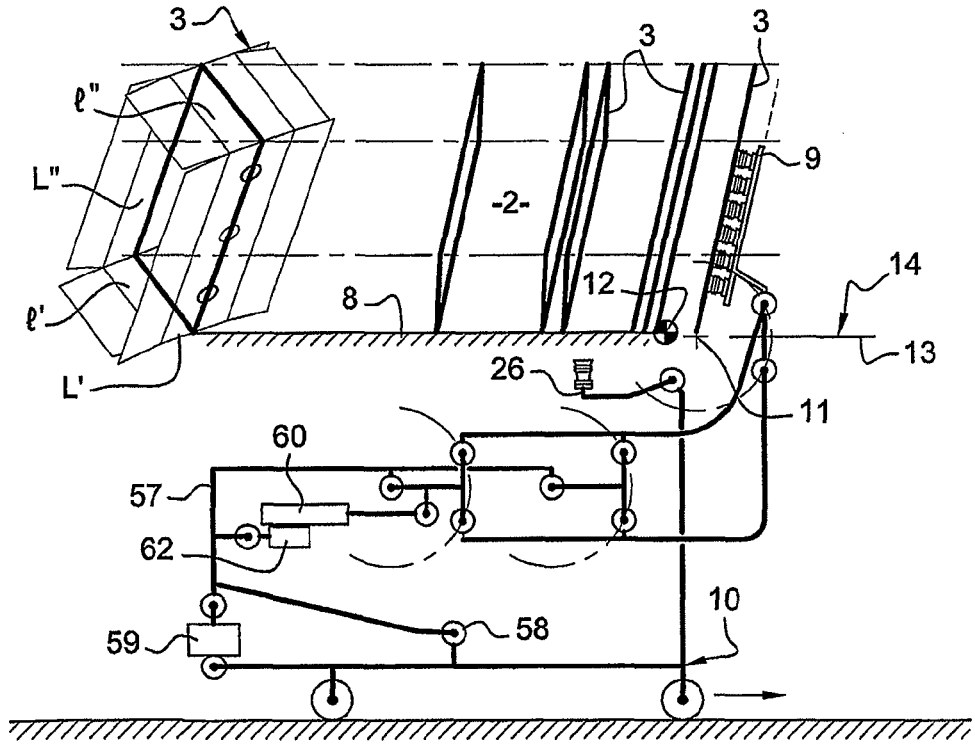
FIGS. 17 to 21 show the various steps between the cutout extraction operation and the assembly of the cutout in the form of an "American box".

FIG. 16 shows the device for maneuvering the extractor arm 9 in the case of "American box"-type cutouts 3.

The pick-up mechanism includes the elements described above for the "wrap-around"-type cutouts 3, and the markings are the same. The originality of the mechanism lies in the presence of the second arm 26, called the forming arm, which serves to hold a face of the cutout 3 while the extractor arm 9 continues its movement, and in the presence of a complementary actuator 62, which enables said cutout 3 to be straightened after its extraction and after its longitudinal movement so as to put angle right said cutout, with respect to the soleplate 14, and in particular the side that will be held by said forming arm 26.

The straightening actuator 62 is in fact positioned between the actuator 60 for maneuvering the crankshafts 34 and the plate 57. It enables, in a relatively simple manner, an additional course to be given to the extractor arm 9 without having to affect the course of the actuator 60, which is provided to perform the extraction and the deposition of the cutout 3 at the forming station 5; this special feature is beneficial for reinforcing the universal nature of the pick-up module C and of the machine in general.

The forming arm 26, which is in the form of an additional instrument, also reinforces the universal nature of the machine by enabling "American box"-type cutouts 3 to be assembled. This arm 26 is secured to the carriage 10 by means of the pivot shaft 28, which is located near the virtual axis 11 of the extractor arm 9, below. This forming arm 26 is maneuvered by means of an actuator 64, shown separately, which causes it to move from a retracted position, as shown in FIGS.

Figure 18:
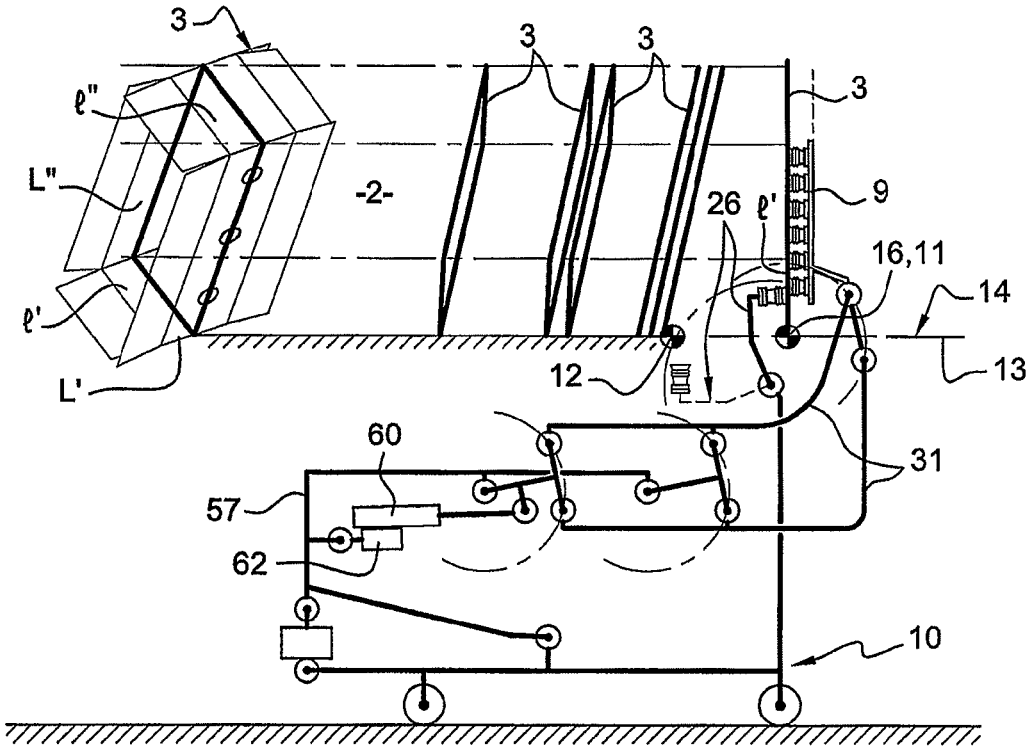
Figure 19:
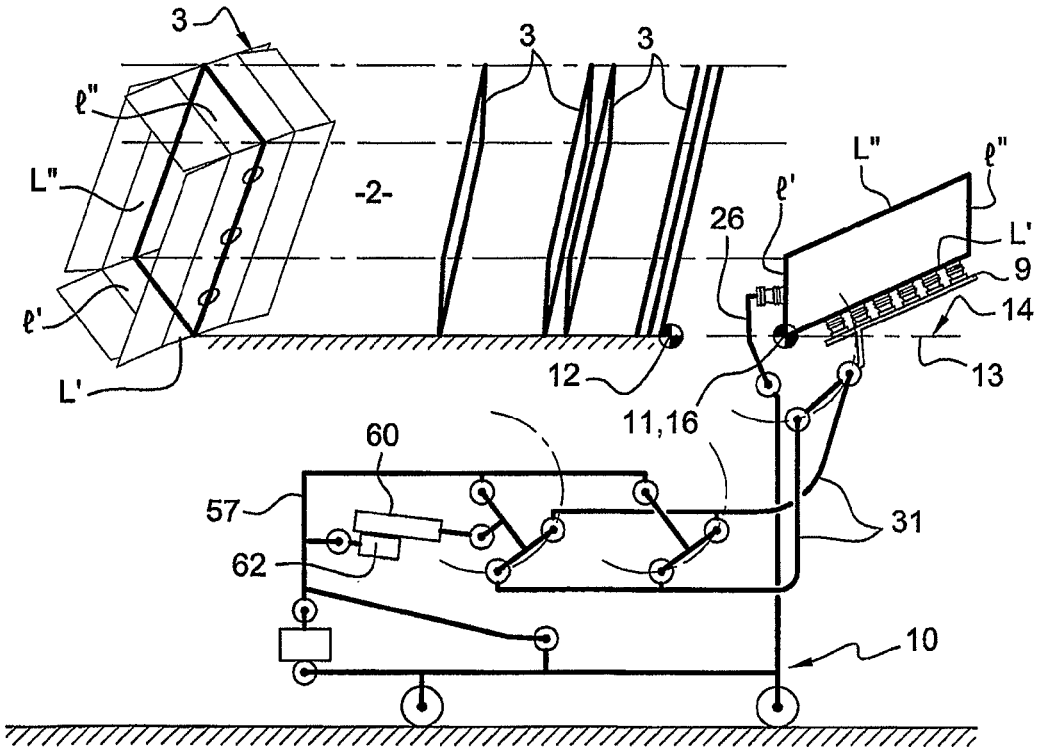

16 and 17, to an active position in which it holds, by means of its suction cup(s), a side of the cutout 3, as shown in FIG. 18.

In the retracted position, the forming arm 26 is arranged under the storage site 2; in the active position, it is located between said storage site 2 and the forming station 5.

The various FIGS. 16 to 21 show the operation of assembling an "American box"-type cutout 3.

The cutout 3 is shown in the figures, at the inlet of the storage site 2, in the form of a blank that is similar to a sheath. This cutout 3 comprises, on the lower downstream side marked L', a lower upstream side $\ell$ and sides L" and $\ell'$ which respectively extend said sides L' and $\ell$; all of these sides can comprise flaps, depending on the case.

In FIG. 16, the extractor arm 9 is in the active pick-up position and its cutouts 41 are in contact with sides L' and $\ell'$ of the cutout 3 located at the outlet of the storage site 2. From there, the carriage 10 moves in the downstream direction (FIG. 17), to move the cutout 3 away from the storage site 2 and, then (FIG. 18) the cutout 3 is positioned vertically; it is placed perpendicularly to the soleplate 14, without interfering with the storage site 2. This vertical positioning of the cutout 3 is performed by means of the actuator 62, which acts on the arm 9 by means of the maneuvering mechanism 30.

In fact, the carriage 10 also moves in the downstream direction by a distance that is sufficient to enable the forming arm 26 to be placed in the active position against side $\ell$ of the cutout 3, as shown in FIG. 18.

Figure 20:
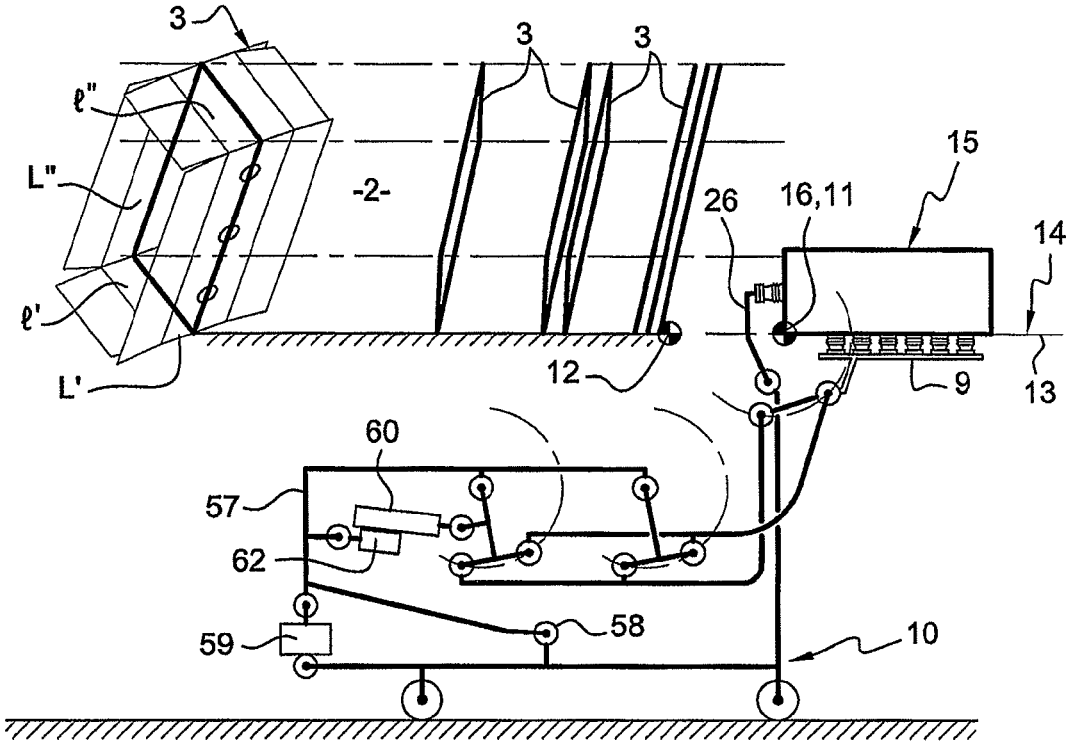

As the forming arm 26 is active (FIG. 19), the extractor arm 9 is pivoted by an actuator 64, and opens the cutout 3, erecting the latter so as to form the blank 15, which is similar to a sheath, as also shown in FIG. 20, at the level of the forming station 5.

It is noted that the virtual axis 11 of the arm 9 coincides with the reference point 16 and with the lower upstream edge of the blank 15.

For particularly compact machines in which the distance D is less than the length of the forming arm 26, it is necessary to wait until the blank 15 has been filled and removed before the carriage 10 can be moved in the downstream direction and enable said forming arm 26 to be retracted and returned to the inactive position, below the level of the soleplate 8 of said storage site 2.

Insofar as there is sufficient space, once the blank 15 is taken over by the conveyor 13, the forming arm 26 can pivot and be retracted below the level of the soleplate 8.

The extractor arm 9 (FIG. 21) is also retracted, but below the level of the soleplate 14, owing to the actuator 59, which actuator 59 causes the plate 57 to pivot around the shaft 58, with respect to the carriage 10, in order to release the blank 15.

Figure 21:
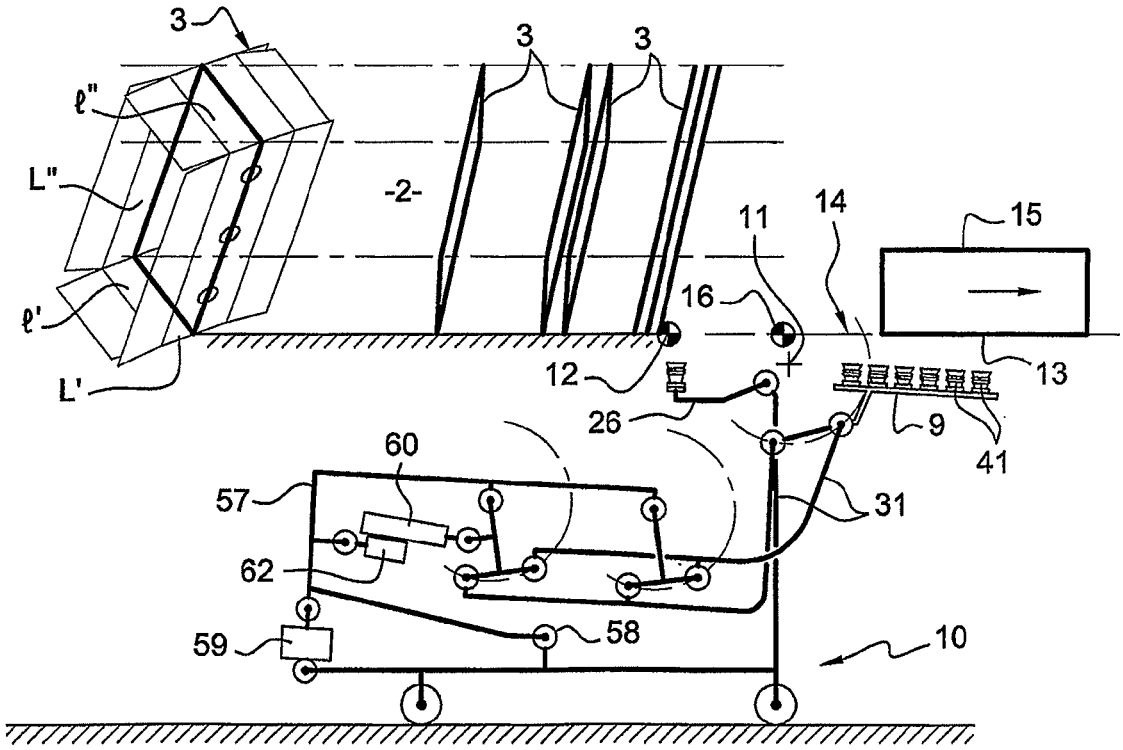

Once the blank 15 has been filled, it is removed by the conveyor 13, freeing the passage for the extractor arm 9, which returns to the storage site 2 in order to pick up a new cutout 3 (FIG. 21).

As indicated above, for cutouts 3 of the "wrap-around" type, the speeds for forming "American box"-type cutouts 3 can be modulated on the basis of the machine configurations.

According to the value of D, the extractor arm 9 can more or less quickly return to its active pick-up position, for a machine where the station 5 acts both as a station for forming cutouts 3 and as a station for filling blanks 15.

When the station 5 is divided, as shown in FIG. 2, the speeds are different, i.e. much faster, by around 50%; indeed, the extractor arm 9 can quickly return to its active position for picking up a new cutout 3 without waiting until the end of the operation for filling the blank 15 that has just been formed.

The invention claimed is:

1. An installation for wrapping and packaging diverse and varied products in a cardboard box, the installation comprises a machine for preparing packages, the machine comprising:

an upstream module M configured as a storage site for storing cardboard cutouts blanks, which will form said packages;

a downstream module V where each of the cardboard cutout blanks is formed into a box blank, said forming performed in a repository of a forming station wherein a reference point corresponds to a lower upstream edge of the box blank; and a central module C, arranged at least in part between said upstream module and said downstream module, equipped with a device for picking up said cardboard cutouts blanks in said storage site, the pick-up device comprising at least one extractor arm that is borne by a carriage capable of moving, and which moves a cardboard cutout blank from among the cardboard cutout blanks extracted from said storage site for deposit at the forming station, wherein the central module comprises a maneuvering mechanism, at least in part, between said extractor arm and said carriage, that comprises a means for pivoting said extractor arm around a virtual axis located, when said cutout is picked up and moved by said carriage, in a stationary horizontal plane that corresponds to both a plane of a soleplate of said storage site and to that of a plane of a soleplate of said forming station.

2. The wrapping and packaging installation according to claim 1, wherein the maneuvering mechanism comprises:

a structure supporting said extractor arm, in a form of a deformable double parallelogram comprising two large sides that form a pair of connecting rods that are pivotably connected to three small sides that are parallel to one another and form segments of a circle, wherein two of the three small sides are each borne by a crankshaft that is pivotably connected to the carriage by shafts that are parallel to the virtual axis of said extractor arm, and a third one of the three small sides acts as a support for said extractor arm and rotates around said virtual axis, and wherein said crankshafts pivot causing said support to move according to a circular movement that enables said extractor arm to move from a position of picking up the cardboard cutout blank in the storage site to a position of depositing said cardboard cutout blank at the forming station, and the reverse.

3. The wrapping and packaging installation according to claim 2, wherein the maneuvering mechanism is arranged on a plate that is borne by the carriage, wherein the carriage is guided on slides or tracks secured to a chassis of the machine and is moved by a drive member of an electric linear motor, and wherein a primary winding is arranged on said carriage and a secondary winding is arranged on said chassis corresponding to said slides or tracks.

4. Wrapping and packaging installation according to claim 1, wherein it comprises an extractor arm that is in the form of a support bar equipped with suction cups, which suction cups are connected to one another, and said support bar is connected, by its ends, to two circuits for activating said suction cups, which circuits are equipped with means enabling them to act together or separately, and said suction cups are equipped, entirely or partially, with three-way valves capable of enabling a maximum number of suction cups to be selected and implemented for the cutout extraction operation, and of isolating one or the other of said circuits so as to enable the deactivation of the suction cup(s) to be bypassed for the forming of said cutout.

5. Wrapping and packaging installation according to claim 4, wherein the support bar (40) with suction cups ahs a length of approximately the dimension of the largest cutout (3) in the case of the "American box", and slightly lower in the case of the "wrap-around".

6. Wrapping and packaging installation according to claim 5, wherein the carriage comprises, for "American box"-type cutouts, in addition to the extractor arm, at least one second arm, called the forming arm, which forming arm is maneuvered by means of an actuator in order to go from an inactive position in which it is retracted below the level of the soleplates and to an active position in which it is located between the cutout and the storage site in order to grip the vertical upstream side l" of said cutout and hold it while said arm pivots the vertical downstream side L' of the cutout on the soleplate of the forming station.

7. Wrapping and packaging installation according to claim 6, wherein the mechanism for maneuvering the extractor arm comprises members for actuating the latter, which comprises two actuators and arranged side by side:

a first actuator that simply brings said extractor arm from its resting position to its active position for picking up the cutout in the storage site and a second actuator that, after movement of the carriage, causes said extractor arm to pivot slightly, and moves the latter, with the cutout, to the vertical position, perpendicular to the bed of the forming station, so as to present the lower upstream side l" of said cutout to the forming arm, which, once it is in position, enables said extractor arm to pivot, for the assembly of said cutout, in which said first actuator is placed between said second actuator and one of the crankshafts, and said second actuator is pivotably connected to the plate of the maneuvering mechanism, secured to said first actuator.

8. Wrapping and packaging installation according to claim 7, wherein the assembly of the mechanism for maneuvering the extractor arm is arranged on the plate, which is itself pivotably connected to the carriage and in particular to a shaft parallel to the virtual axis of said extractor arm, which plate is capable of being moved by an actuator, for example, to enable said assembly, and in particular said extractor arm, to pivot so as to temporarily retract it below the level of the soleplate of the forming station and with respect to the bottom of the box blank, before said carriage returns to its starting position.

9. The wrapping and packaging installation according to claim 1, wherein the forming station comprises both a station for forming and a station for filling the box blank made from the cardboard cutout blank, and wherein a distance D separates the reference point of said forming station and an edge of an outlet of the soleplate of the storage site.

10. The wrapping and packaging installation according to claim 9, wherein D is less than a length of said extractor arm or D is approximately the length of said extractor arm.

11. The wrapping and packaging installation according to claim 9, wherein D is approximately the length of said extractor arm.

12. The wrapping and packaging installation according to claim 1, wherein, the filling station downstream from the forming station at a distance P from said forming station that enables the extractor arm to return to an active pick-up position upon removal of the box blank that was shaped at said forming station during an operation of filling said box blank.

13. The wrapping and packaging installation according to claim 1, wherein the storage site stores the cardboard cutout blanks on a first-in first-out basis.

14. The wrapping and packaging installation according to claim 1, wherein the virtual axis, when said cutout is picked up and moved by said carriage, is located, within the cardboard thickness range, in the stationary horizontal plane that corresponds to both the plane of said soleplate of said storage site and to the plane of the soleplate of said forming station.

* * * * *